US005655183A

United States Patent [19]

Tombs

[11] Patent Number: 5,655,183

[45] Date of Patent: Aug. 5, 1997

[54] IMAGE FORMING APPARATUS WITH A TRANSFER STATION ERASE

[75] Inventor: Thomas N. Tombs, Brockport, N.Y.

[73] Assignee: Eastman Kodak Company, Rochester, N.Y.

[21] Appl. No.: 355,774

[22] Filed: Dec. 14, 1994

[51] Int. Cl.[6] ..... G03G 21/00

[52] U.S. Cl. ..... 399/127; 399/297

[58] Field of Search ..... 355/271, 273, 355/274, 277, 210, 211, 219; 399/127, 128, 186, 297, 315

[56] References Cited

U.S. PATENT DOCUMENTS

| | | | |
|---|---|---|---|
| 3,684,362 | 8/1972 | Weigl | 355/220 |
| 3,707,138 | 12/1972 | Cartwright | 118/637 |
| 3,734,724 | 5/1973 | York | 96/1.4 |
| 3,784,300 | 1/1974 | Hudson et al. | 355/273 |
| 3,851,230 | 11/1974 | Okamoto et al. | 317/262 A |
| 4,014,605 | 3/1977 | Fletcher | 355/309 X |
| 4,348,098 | 9/1982 | Koizumi | 355/274 |
| 4,538,901 | 9/1985 | Soumiya | 355/273 |
| 4,615,607 | 10/1986 | Yanagawa et al. | 355/326 R |
| 5,012,293 | 4/1991 | Aldrich et al. | 355/274 |
| 5,184,146 | 2/1993 | Tanaka et al. | 358/296 |
| 5,361,125 | 11/1994 | Fletcher | 355/271 |

*Primary Examiner*—William J. Royer
*Attorney, Agent, or Firm*—Norman Rushefsky

[57] ABSTRACT

Transfer of a toner image from an image member to either an intermediate member or a receiving sheet is improved by irradiating a photoconductive layer in the image member during transfer. Erasing radiation is allowed to fall on both the in-nip region and a pre-nip region but is baffled from a post-nip region. The erasing radiation increases the time constant of the system thereby slowing the build-up of the field in the pre-nip region inhibiting pre-nip ionization. The lack of erasing radiation in the post-nip region decreases the time constant thereby speeding the reduction in the field and also reducing ionization in that region.

6 Claims, 1 Drawing Sheet

IMAGE FORMING APPARATUS WITH A TRANSFER STATION ERASE

This invention relates to image forming apparatus in which an electrostatically held toner image is transferred to a receiving surface, which receiving surface can be either a surface of a receiving sheet or of an intermediate transfer member.

In electrostatic transfer of toner images a transfer field is created either by spraying the back of a receiving sheet with corona or by the creation of a field between the image member carrying the toner image and a backing member, typically a roller, for the receiving sheet. Similarly, transfer of toner images to an intermediate roller or web is done in a field created between the intermediate roller or web and the image member.

In electrostatic transfer using an intermediate or a backing member such as a roller, the problems associated with pre-nip and post-nip ionization are well documented. For example, see U.S. Pat. No. 4,014,605, granted to Fletcher Mar. 29, 1977 and references cited therein, and Canadian Patent Application 2,079,609, Fletcher, published Jun. 13, 1993, in which it is pointed out that if a transfer field is too high in the pre-nip area, premature transfer takes place across an air gap which leads to decreased resolution and spreading of the image. Many other closely related problems are discussed. In the post-nip region other problems are caused if the field is again too high, including sheet separation problems and image instability. Obviously, a high transfer field is desired in the "in-nip" region. This reference suggests use of a transfer backing member or intermediate having a photoconductive characteristic and an erase lamp that is concentrated on the post-nip area but shielded from the pre-nip area. See also, U.S. Pat. Nos. 3,851,230 to Okamoto et al, Nov. 26, 1974, and Pat. No. 5,012,293, Aldrich et al, Apr. 30, 1991.

The use of erase lamps associated with transfer is well known, see for example, U.S. Pat. Nos. 3,684,362, to Weigl, issued Aug. 15, 1972; 3,734,724 to York issued May 22, 1973 and 3,707,138 to Cartwright; issued Dec. 26, 1972.

Use of an erase in the "in-nip" region improves the transfer of difficult to transfer toner images. However, the erase lamp increases the size of the field in the post-nip region which reduces the latitude of the system by forcing consideration of problems from post-nip ionization.

SUMMARY OF THE INVENTION

An analysis of the time constant or response time associated with the field change in the pre-nip, in-nip and post-nip regions of the above system leads to significant improvement in that system. Transfer rollers and similar backing members and intermediate members usually have a semi-conductive (or intermediate conductivity) blanket to help control ionization in both the pre-nip and post-nip regions. The electric field in the transfer nip increases as the image passes into the nip when a roller with a semi-conductive blanket is employed. It decreases as the image passes out of the nip.

The response time of the electric field is determined by several parameters (resistance and capacitance are per unit area): the resistivity of the roller blanket $\rho_r$, the capacitance of the roller $C_r$, the thickness of the roller blanket $d_r$, the capacitance of the photoconductor $C_p$, the capacitance of the toner stack $C_t$, the resistance of the paper (if any) $R_p$, the capacitance of the paper (if any) $C_p$, and the air gap spacing between the toner and the paper (if any) in all areas of the nip $d_g$ (or between the toner and an intermediate roller if no paper).

For example, consider the configuration of transfer from a photoconductive image member to an intermediate roller in which no paper is involved. By solving the equivalent lumped parameter circuit, the response time $\tau$ is approximated by:

$$\tau=\rho_r d_r(C_r+1/(d_g/\epsilon_0+1/C_p+1/C_t))$$

Where $\epsilon_0$ is the permittivity of free space or air which is $8.854\times10^{12}$ F/m. The equation with paper is more complicated but similar.

From the equation it can be seen that the response time depends on the capacitance of the photoconductive portion of the image member and that, therefore, it can be altered by erasing that portion during transfer. More specifically, if the photoconductor is illuminated at any time during transfer, the response time is increased.

Concentrating on pre-nip and post-nip areas, a large response time turns out to be desirable in the pre-nip region because it delays build-up of the field and, therefore, reduces pre-nip ionization. At the same time, a low response time is desirable in the post-nip region to reduce the field rapidly and prevent post-nip ionization.

It is, thus, an object of the invention to improve transfer of toner images to either a receiving sheet or an intermediate member by reduction of pre-nip and/or post-nip ionization.

This and other objects are accomplished by an image forming apparatus including an image member upon which a toner image is electrostatically held, the image member having at least a photoconductive layer and a conductive layer on a transparent support. A transfer station is positioned to transfer the toner image to a transfer surface of a transfer member or a receiving sheet positioned between the transfer member and the image member. The transfer station includes a transfer member positioned to define a transfer nip with the image member, the image member being movable through the nip and defining, with the transfer member, in the direction of movement, pre-nip, in-nip and post-nip regions, the in-nip region being the region in which substantial transfer takes place and the pre-nip and post-nip regions being immediately before and after the in-nip region and being regions in which the transfer member and image member are more separated than they are in the in-nip region. The transfer station includes means for applying an electrical field between the transfer member and the conductive layer of the image member of a direction urging the toner image to transfer to the transfer surface and a source of erasing radiation positioned to eradiate the photoconductive layer in the pre-nip and in-nip regions but not in the post-nip region.

Because the erasing radiation increases the response time of the system, it is used in the pre-nip area to slow build-up of the field. However, it is not used in the post-nip area. The immediate increase in resistance of the photoconductive layer from the absence of the erase radiation reduces the response time and facilitates more rapid reduction of the field in the post-nip area. The invention thus reduces both pre-nip and post-nip ionization and permits a higher electrical field to be applied to the system, thereby improving transfer efficiency as well as latitude.

Prior art cited above generally does not have a semi-conductive transfer member and, therefore, concentrates erasing radiation in the post-nip area and baffles the pre-nip area, which is directly contrary to this approach.

DETAILED DESCRIPTION OF THE INVENTION

Figure 2:
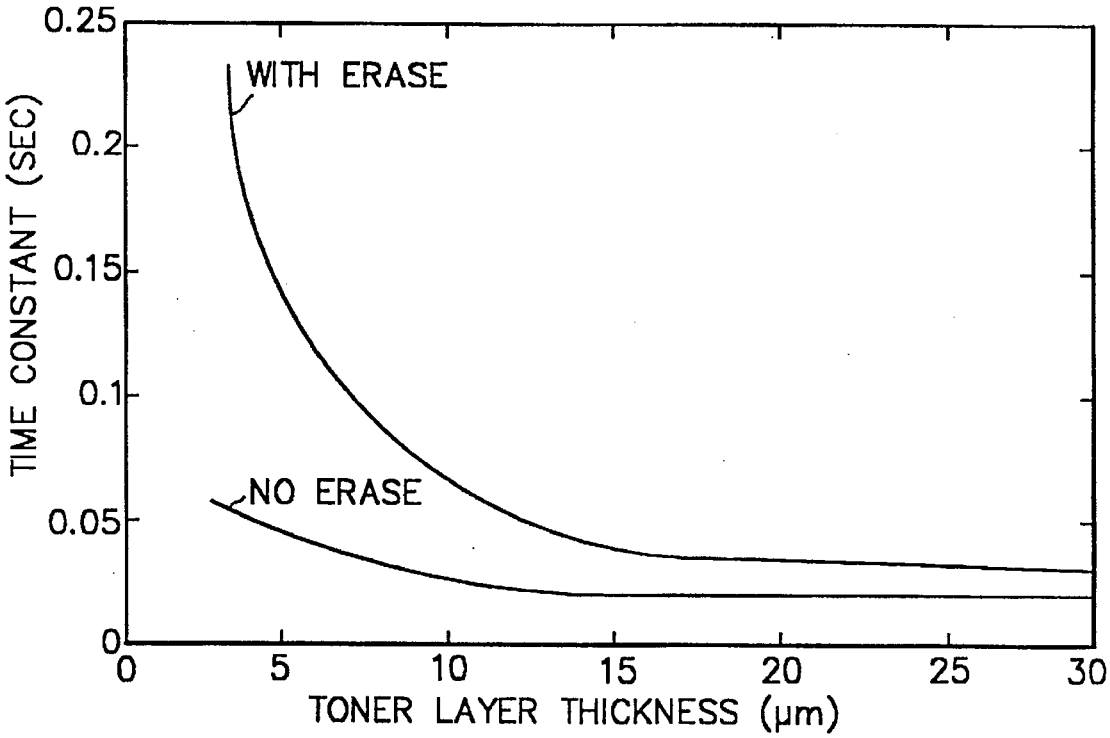
FIG. 2 is a graph showing the change in the time constant according to toner layer thickness, both with an erase and without an erase.

An advantage of using an erasing illumination during transfer is shown in FIG. 2 where the time constant of the system is plotted against the toner layer thickness utilizing the equation set out above for the time constant. Note that with an erase, the time constant is lower with higher stack heights of toner. With no erase the curve is much flatter. This suggests that erase is desirable in the in-nip region since the field increases faster in conditions of high toner where it is most needed, thereby providing more efficient transfer and better system latitude. This actually allows the electric field in the thick toner stacks to rise to a higher value without causing ionization of the thin stacks, which is certainly a desirable result. These curves were generated using the following parameters: $\rho_r=10^9$ Ω-cm, $d_r=5$ mm, $C_f=1.417$ μF/m$^2$, $C_r=11.51$nF/m$^2$, $d_g=0.1$ μm, dielectric constant of toner stack=1.7.

Figure 1:
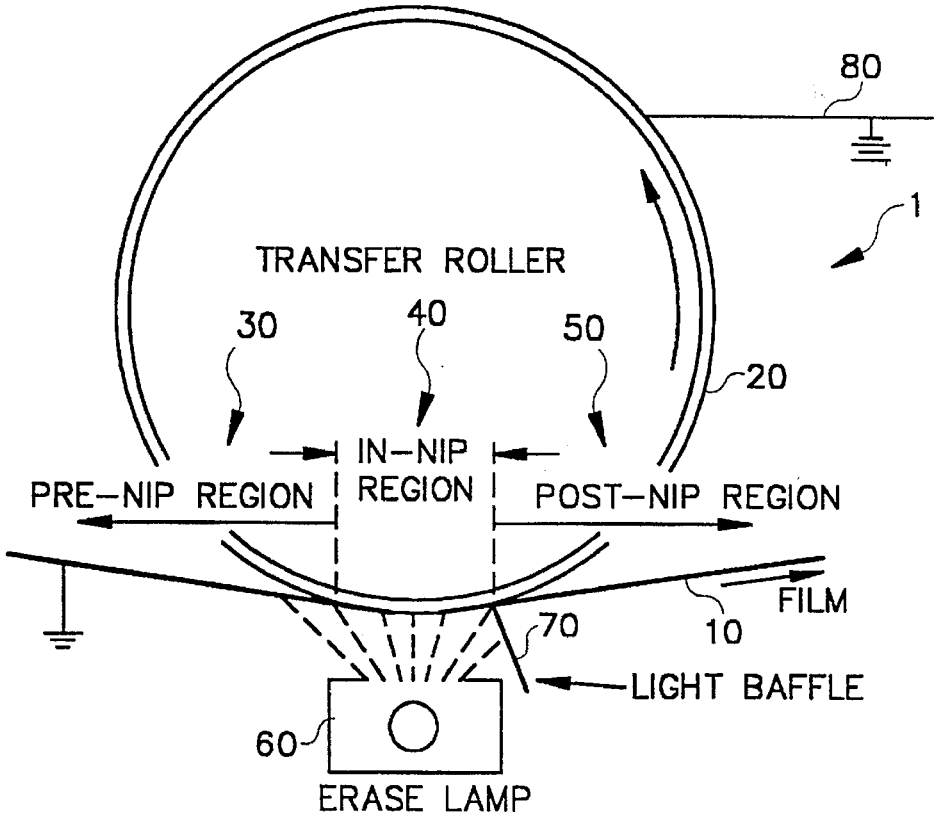
FIG. 1 is a side schematic of a transfer station.

According to FIG. 1, a transfer station 1 includes a transfer member, for example, a transfer roller 20. Since the invention is effective for transfer from an image member to either a receiving sheet or an intermediate member, the transfer member 20 can either be the intermediate member or it can be a backing roller for the transfer sheet.

The transfer member usually includes a blanket of intermediate conductivity, for example, between $10^5$ and $10^{12}$ ohm-cm. This conductivity supports creation of a field but does not exhibit pre-nip ionization to the extent a metallic transfer member would.

An image member 10 moves through the transfer station 1 carrying a toner image that has been formed electrostatically, for example, electrophotographically. The toner image is made up of freely divided toner particles generally charged to a single polarity which are responsive to an electric field. The image member 10 is preferably made up of a transparent support and has generally a number of layers including at least a conductive layer and a photoconductive layer. A source of radiation 60 is positioned behind image member 10 for irradiating the photoconductive layer through the transparent support. The wave length of the radiation depends upon the sensitivity of the photoconductive layer and need not be visible radiation.

The overall nip-region is shown divided into a pre-nip region 30 an in-nip region 40 and a post-nip region 50. It is desirable that transfer take place in the in-nip region. The pre-nip region and the post-nip region both involve separation of the image member 10 from the transfer member 20. Transfer in these areas is well known to be undesirable. In most systems, the transfer surface contacts the image member only in the in-nip region. In some systems, there is no such contact, and transfer takes place across a narrow gap in the in-nip region.

The response time of the system affects each of the regions. Using the formula laid out above for the response time, it can be seen that the use of an erase lamp for eliminating the resistance of the photoconductor increases the response time of the system where the erase is effected. As shown in FIG. 1, the erase lamp is designed to erase portions of the photoconductive layer passing through both the pre-nip region and the in-nip region. In the pre-nip region this has the effect of increasing the response time and slowing the rise of the field, thereby reducing the likelihood of pre-nip ionization. In the in-nip region erase has the effect noted in FIG. 2 which improves actual transfer, especially of difficult to transfer high toner stacks. A baffle 70 is positioned to prevent radiation from falling on image member 10 in the post-nip region 50. This reduces the response time from that of the other two regions and facilitates a rapid reduction of the field in the post-nip region, thereby preventing the harmful effects of the post-nip ionization.

A source of potential 80 is applied to transfer member 20. The conductive layer in image member 10 is generally grounded. Source 80 is commonly a constant current source which lays down a constant amount of charge across the length of transfer roller 20. However this invention works, regardless of the type of source, including, for example, a constant voltage source.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising an image member for holding a toner image, the image member having at least a photoconductive layer and a conductive layer on a transparent support, and a transfer station for transferring the toner image to a transfer surface of a transfer member or a receiving sheet positioned between the transfer member and the image member, said transfer station including;

a transfer member positioned to define a transfer nip with the image member, the image member being movable through the nip and defining, in the direction of image member movement, with the transfer member, pre-nip, in-nip and post-nip regions, the in-nip region being the region in which substantial transfer takes place and the pre-nip and post-nip regions being immediately before and after the in-nip region and being regions in which the transfer member and image member are more separated than they are in the in-nip region, means for applying an electrical field between the transfer member and the conductive layer of the image member of a direction urging the toner image to transfer to the transfer surface in the in-nip region, and a source of erasing radiation positioned to irradiate the photoconductive layer in the pre-nip and in-nip regions but not in the post-nip region.

2. Image forming apparatus according to claim 1 wherein the source of erasing radiation is positioned on a side of the image member opposite the transfer member and irradiates the photoconductive layer through the transparent support and wherein said transfer station further includes a baffle for preventing radiation from reaching the post-nip region.

3. Image forming apparatus according to claim 1 wherein the transfer surface is the surface of a receiving sheet positioned between the image member and the transfer member.

4. Image forming apparatus according to claim 1 wherein the transfer surface is a surface of the transfer member the transfer member has a resistance of at least $10^5$ ohm-cm.

5. Image forming apparatus according to claim 1 wherein the transfer member is a roller or endless web having a layer with a resistance between $10^5$ ohm-cm and $10^{12}$ ohm-cm.

6. Image forming apparatus comprising an image member for holding a toner image, the image member having at least a photoconductive layer, a conductive layer and a transparent support, and a transfer station for transferring the toner image to a surface of a transfer member, the transfer member having a resistance of at least $10^5$ ohm-cm and being positioned to define a transfer nip with the image member, the image member being movable through the nip and defining in the direction of the image member movement, with the transfer member, pre-nip, in-nip and post-nip regions, the in-nip region being the region at which substantial transfer takes place and the pre-nip and post-nip regions being immediately before and after the in-nip region and being regions in which the transfer member and image member are more separated than they are in the in-nip region, means for applying an electrical field between the transfer member and the conductive layer of the image member of a direction urging the toner image to transfer to the transfer surface in the in-nip region, a source of erasing radiation positioned to irradiate the photoconductive layer in the pre-nip and in-nip regions and means for preventing radiation from the source from reaching the photoconductive layer in the post-nip region.

* * * * *